United States Patent [19]

LeBoutet

[11] 4,056,728

[45] Nov. 1, 1977

[54] MAGNETIC DEFLECTING AND FOCUSING DEVICE FOR A CHARGED PARTICLE BEAM

[75] Inventor: Hubert LeBoutet, Paris, France

[73] Assignee: C.G.R.-Mev., France

[21] Appl. No.: 481,117

[22] Filed: June 19, 1974

Related U.S. Application Data

[63] Continuation of Ser. No. 326,957, Jan. 26, 1974, abandoned.

[30] Foreign Application Priority Data

Jan. 31, 1972 France ..... 72.03136

[51] Int. Cl.[2] ..... H01J 3/14

[52] U.S. Cl. ..... 250/396 R; 250/493

[58] Field of Search ..... 250/396, 397, 398, 399, 250/400, 492, 493; 328/230; 335/210; 313/361

[56] References Cited

U.S. PATENT DOCUMENTS

| | | | |
|---|---|---|---|
| 3,287,584 | 11/1966 | Pinel | 250/398 |
| 3,360,647 | 12/1967 | Avery | 250/399 |
| 3,448,263 | 6/1969 | Boutet | 250/396 |
| 3,660,658 | 5/1972 | LeBoutet | 250/398 |

*Primary Examiner*—Craig E. Church

*Attorney, Agent, or Firm*—Cushman, Darby & Cushman

[57] ABSTRACT

This device makes it possible to achieve upon a target of predetermined position, the simultaneous focusing of a beam of accelerated particles, in two mutually perpendicular planes, this, whatever the energies of said particles. The device comprises two electromagnets $E_1$ and $E_2$ whose entry and exit faces are parallel with one another, and a third electromagnet $E_3$ whose entry and exit faces are at an angle $\gamma$. Relationships are given to determine the different parameters defining the dimensions and positions of the electromagnets in relation to one another being linked by determinate relationships. The device can be utilized in physical and biological researches, as well as in medical irradiation units.

5 Claims, 3 Drawing Figures

MAGNETIC DEFLECTING AND FOCUSING DEVICE FOR A CHARGED PARTICLE BEAM

Figure 1:
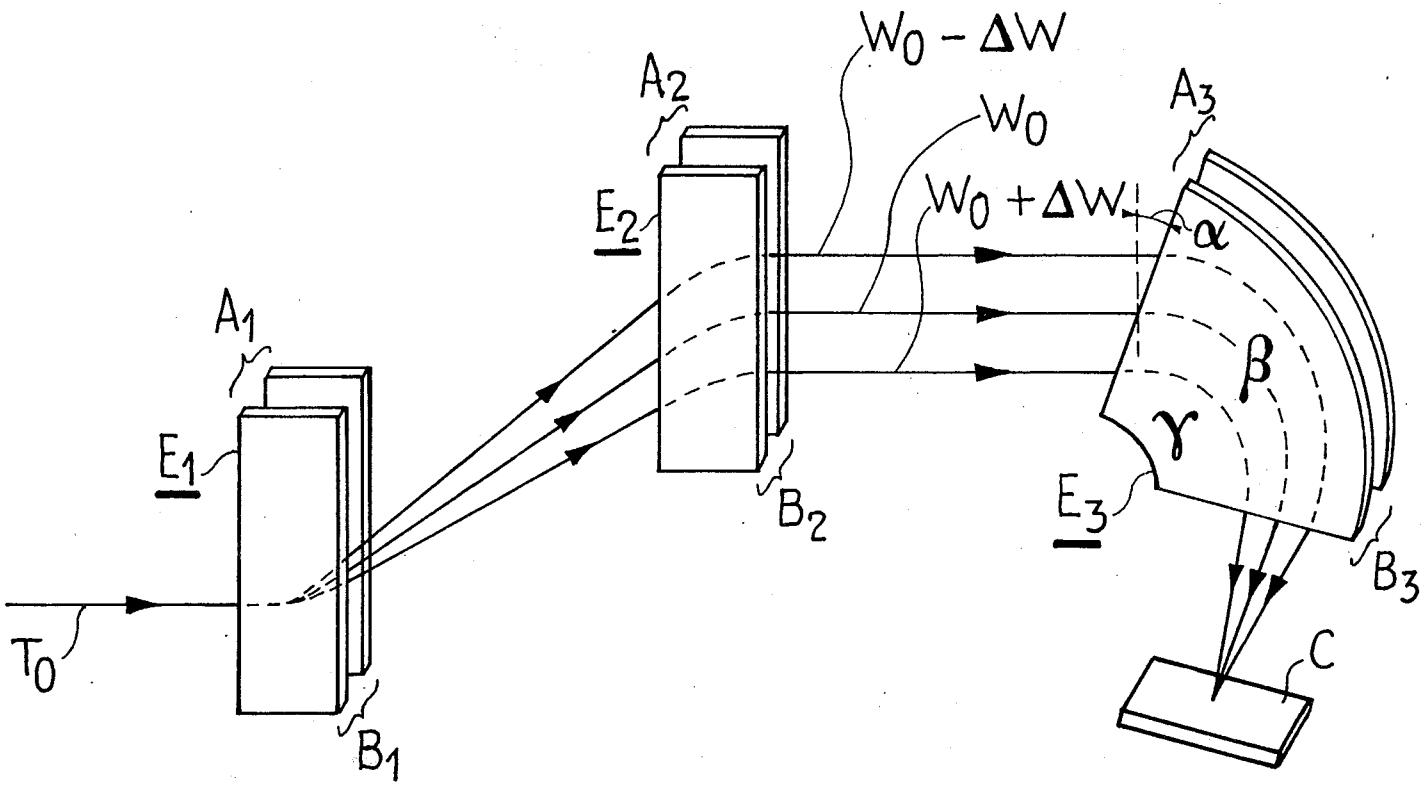

This is a continuation, of application Ser. No. 326,957 filed Jan. 26, 1973, now abandoned.

In certain medical or industrial applications involving particle accelerators, it is frequently desirable to be able to modify the trajectory of the accelerated particle beam or focus it upon a given target, without any need to displace the accelerator which is generally very bulky and heavy.

To this end, magnetic deflection systems for beams of accelerated particles have been developed, in particular for linear accelerators. In these designs, the accelerator is fixed and the magnetic deflection system can revolve around an axis which is coincidental with the axis of the beam emerging from the accelerator.

However, when it is necessary to deflect very high energy particle beams (deuton beams accelerated by a 20 Mev cyclotron for example) on to a target having a predeterminate position, the deflectors of conventional kind cannot be used, because their weight and size are too great to obtain a good such accuracy to be achieved.

This invention relates to a magnetic deflecting and focusing device for deflecting and focusing a beam of accelerated particles, this device having a relatively small weight and volume and makes it possible to produce a very good quality focal spot upon a target having a predetermined position.

In accordance with the invention, a magnetic deflecting and focusing device for a beam of accelerated charged particles having an incident mean path $T_o$, comprising, in combination, magnetic means for translating said beam in a direction perpendicular to said incident mean path $T_o$ to obtain a translated beam parallel to said incident mean path $T_o$, the particle paths of said translated beam being dependent upon the momentum of said particles, and magnetic means for deflecting and focusing said translated beam upon a target having a predetermined position, said magnetic means for translating and said magnetic means for deflecting and focusing said beam being positioned and configured so as to achieve convergence of said particle beam on said target in two mutually perpendicular planes whose intersection is coincidental with the mean path of said beam emerging from said device, the positioning and configuration of said magnetic means further being such that momentum convergence of said particle beam is simultaneously achieved on said target; said magnetic means for translating said beam comprising a first and a second electromagnet having respectively an entry face and an exit face parallel to one another; the entry face $A_1$ of said first electromagnet being perpendicular to said incident mean path $T_o$ and the exit face $B_2$ of said second electromagnet being perpendicular to said particle beam emerging from said second electromagnet; the entry face $A_2$ of said second electromagnet being parallel to the exit face $B_1$ of said first electromagnet and said faces $A_2$ and $B_1'$ being spaced of an interval of:

$$d = 2r/tg\theta$$

the normal to said beam at the exit face $B_1$ and at the entry face $A_2$ being respectively at an angle $\theta$ with said entry face $A_1$ and said exit face $B_2$ and $r$ being the radius of curvature of said particle beam within said first and second electromagnet.

FIG. 1 illustrates a magnetic deflection device for a particle beam, in accordance with the invention.

Figure 2:
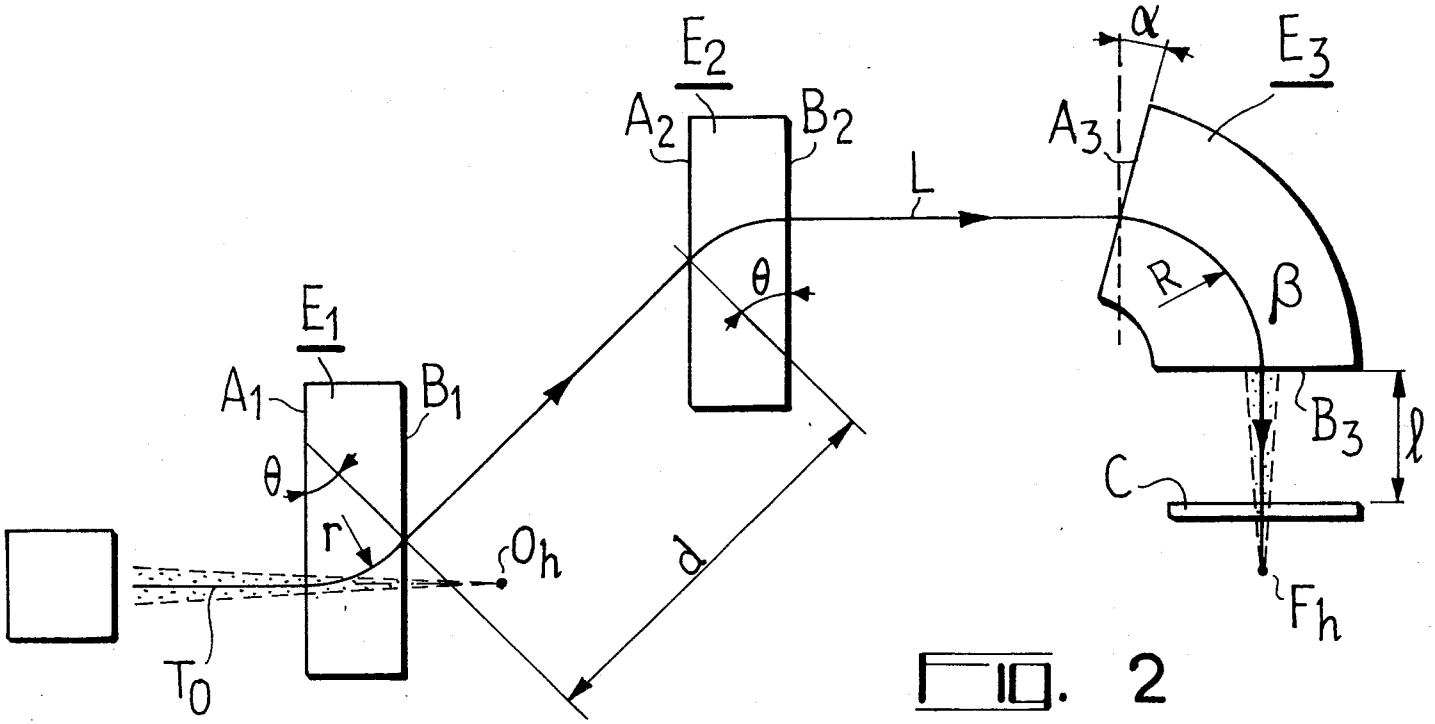

FIG. 2 schematically illustrates a variant embodiment of the device in accordance with the invention.

Figure 3:
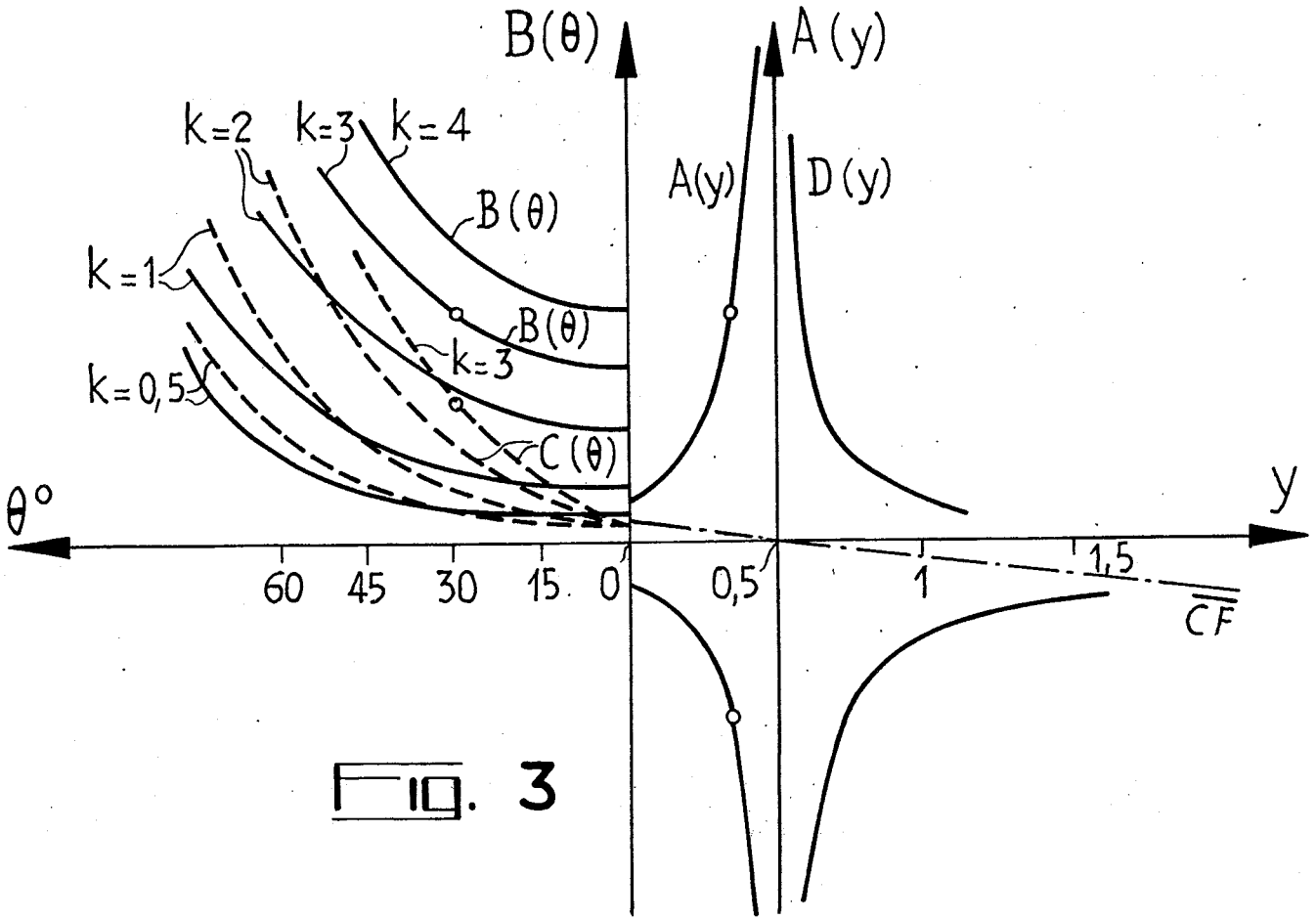

FIG. 3 illustrates graphs $A(y)$, $D(y)$, $S(\Theta)$ and $C(\Theta)$, corresponding to different values of the parameter k.

The magnetic deflecting device for a particle beam shown in FIG. 1, comprises a first electromagnet $E_1$ whose entry $A_1$ and exit $B_1$ faces are parallel to one another, a second electromagnet $E_2$ whose entry $A_2$ and exit $B_2$ faces are parellel to one another and parallel to the faces $A_1$ and $B_1$ of the first electromagnet $E_1$, and a third electromagnet $E_3$ having an entry face $A_3$ and an exit face $B_3$, the entry face $A_3$ making an angle $\alpha$ with the normal to the trajectory of the beam entering said third electromagnet $E_3$.

The magnetic fields created in the air gaps of the respective electromagnets $E_1$ and $E_2$ are identical, these magnetic fields which have a constant value in said air gaps, bending the mean path $T_o$ of the particle beam, whose mean momentum is $W_o$, with a radius of curvature r within said electromagnets $E_1$ and $E_2$. If the normal to the emergent beam and the normal to the incident beam are respectively at an angle $\theta$ with the entry face $A_1$ and exit face $B_2$, as shown in FIG. 2, then the distance separating the entry face $A_2$ of the electromagnet $E_2$ from the exit face $B_1$ of the electromagnet $E_1$, is given by the relationship $d = 2r/tg\theta$. L will be used to designate the distance separating the face $E_3$ from the face $B_2$, R the radius of curvature of the mean path of the beam in the third electromagnet $E_3$, and $\beta$ the rotation angle of the mean path of the beam, within said electromagnet $E_3$. As those skilled in the art will be aware, the values of $r$ and R depend upon the nature and momentum of the particles, and upon the strength of the magnetic field in the electromagnets.

The magnetic deflecting device in accordance with the invention is such that a particle beam entering said device along a mean trajectory $T_o$ substantially perpendicular to the face $A_1$ of the electromagnet $E_1$, the mean momentum of the particles being equal to $W_o$, can be focused upon a target C located at a distance 1 from the exit $B_3$ of the third electromagnet $E_3$, this focusing achieving both in the vertical plane (plane perpendicular to the figure) and in the horizontal plane (plane of the figure), this double focus likewise being a momentum focus.

This triple focusing on the target C is obtained by a judicious choice of the parameters, $r$, R, $\theta$, $\alpha$, $\beta$, d, L and l, taking into account the momentum of the particles in the incident beam and the shape and angle of incidence of the beam at entry to the device.

First of all, it is considered the case of a parallel incident beam entering the electromagnet $E_1$ perpendicularly to the face $A_1$. Then, a focus $F_v$ (corresponding to a focusing in the vertical plane) is obtained if:

$$-1 - D_v(1 + R\beta) = 0$$

or:

$$D_v = -\frac{1}{R}\ \frac{1}{\beta + \frac{1}{R}} - D_v = \frac{tg\,\alpha}{R}$$

$D_v = tg\alpha/R$ being the convergence of the device in this vertical plane and $\beta$ being the rotation angle of the beam in the electromagnet $E_3$.

To obtain a horizontal focus $F_h$ coincidental with the vertical focus $F_v$, then the condition: $R.D_h - (l/R) = 0$ must be satisfied, $D_h = tg\alpha/R$ being the convergence of the device in the horizontal plane.

The foci $F_v$ and $F_h$ will be concidental if, putting $l/R = y$:

$$|tg\alpha|' = 1/(y + \beta) \quad (1)$$

and $D_h = -D_v$, i.e.:

$$1 - y(y + \beta)/(y + \beta) = 0 \quad (2)$$

On the other hand, in order to obtain upon the target C a focus of momentum $F_w$ coincidental with the vertical focus $F_v$, it is necessary to have the following conditions:

$$\frac{1 - y(y + \beta)}{y + \beta} \cdot 2r \cdot \left(\frac{2}{\cos\theta} - 1\right) - R(1 + y) = 0 \quad (3)$$

and:

$$\frac{a\,p_o + b(L)}{c\,p_o + g(L)} = 0 \quad (4)$$

$a$, $b$, $c$, and $d$ being parameters which are a function of $\theta$, $\alpha$, $\beta$, $r$ and R, or in other words:

$$a = R\,D_h - \frac{l}{R}$$

$$b(L) = \left(R\,D_h - \frac{1}{R}\right)\left[2r\,tg\,\theta\left(1 + \frac{1}{\sin^2\theta}\right) + L\right] + R$$

$$c = -\frac{1}{R}$$

$$g(L) = -\frac{1}{R}\left[2r\,tg\,\theta\left(1 + \frac{1}{\sin^2\theta}\right) + L\right]$$

where $p_o$ designates the distance separating the entry face $A_1$ of the first electromagnet $E_1$, from the point of convergence $O_h$ (in the horizontal plane) of the incident beam.

However, the conditions (1), (2), (3) cannot be strictly satisfied simultaneously, for a parallel incident beam, since this leads to:

$$y = -1, \text{ i.e. } l = -R$$

In the following, for a parallel incident beam, the conditions required for the achievement of strict coincidence of the foci $F_v$ and $F_w$ (foci in the vertical plane) upon the target, and approximate coincidence of the horizontal focus $F_h$ thereon, will be set out.

Thus, in this case (parallel incident beam), $p_o$ equal to infinity and equation (4) can be written:

$$a/c = 0$$

which shows that the operation of the device is independant of L, and the conditions (1), (2) and (3) cannot be strictly simultaneously satisfied since this, as it was already stated, lead to:

$$y = -1, \text{ i.e. } l = -R.$$

By writing $k = r/R$, the equation (3) can be rewritten as:

$$2k\left(\frac{2}{\cos\theta} - 1\right) = \frac{(1 + y)(y + \beta)}{1 - y(y + \beta)}$$

The FIG. 3 shows the variation of $$2k\left(\frac{2}{\cos\theta} - 1\right) = B(\theta)$$

and:

$$\frac{(1 + y)(y + \beta)}{1 - y(y + \beta)} = A(y)$$

for the different values of $k$. These graphs indicate the approximate coincidence of the focus $F_h$ (focus in the horizontal plane) with the target C, and for $\beta = \pi/2$.

The graphs A ($y$) and B ($\theta$) shown in FIG. 3, make it possible to choose a pair of values ($\theta$, $y$) and the corresponding value $k$, in order to achieve strict coincidence of the foci $F_v$ and $F_w$ with the target C. However, this parameter will also be so chosen that the horizontal focus $F_h$ is as close as possible to the target C, since it has been demonstrated hereinbefore that strict coincidence of the foci $F_v$, $F_w$ and $F_h$ cannot be obtained in the case of a parallel incident beam.

If $CF_h$ is the distance separating the focus $F_h$ from the target C, then it may be written:

$$\frac{CF_h}{R} = \frac{1 - y(y + \beta)}{y + \beta} \neq 0 \quad (6)$$

The approximate equation (6) replacing the balanced equation (2) which is incompatible with the balanced equations (1) and (3), in the case of a parallel beam.

The graph representing $CF_h/R$ as a function of $y$ (FIG. 3), shows that for:

$$0 < y < 0{,}5$$

to the value of $CF_h/R$ is relatively small ($0 < CF_h/R < 0{,}57$) and that for a suitably selected value of y, the particle beam substantially has a triple focus at the level of the target C ($F_v$, $F_w$, $F_h$ are very close to each other).

If it is desired to achieve strict simultaneity of the foci $F_v$, $F_w$ and $F_h$ on the target, then the incident beam should not be parallel but should be slightly convergent, and the point of convergence $O_h$ in the horizontal plane should be conjugate with $F_h$ in relation to the assembly of the magnetic translating and deflecting device (FIG. 2).

In this case, the distance $\overline{O_hA_1}$ separating the object point $O_h$ from the entry face $A_1$ of the device, should be equal to:

$$-\overline{O_hA_1} = 2k\,tg\,\theta\left(1 + \frac{1}{\sin^2\theta}\right) + K + \frac{y + \beta}{1 - y(y + \beta)} \quad (7)$$

where: $K = L/R$ and $k = r/R$

In the particular case where:

$$\beta = \pi/2$$

Putting:

$$D(y) = \frac{y + \frac{\pi}{2}}{y\,(y + \frac{\pi}{2}) - 1}$$

and:

$$C(\theta) = 2k\,tg\,\theta\,(1 + \frac{1}{\sin^2\theta}) + K$$

the graphs D (y) and C (θ) have been plotted for $\beta = \pi/2$ in FIG. 3. It is then possible, thanks to the family of curves A (y), B (θ), D (y) and C (θ), to select values of the parameters $r$, $\theta$, $d$, $l$, L and R, which simultaneously satisfy the equations (1), (2), (3) and (4), and make it possible to achieve "triple focusing" of the beam upon the target C.

Below, a choice, which is by no means limitative, of parameters defining a magnetic deflecting device in accordance with the invention, has been given:

| | | |
|---|---|---|
| $\beta = \frac{\pi}{2}$ | | |
| y = 0.35 | → | l = 0,35 R<br>R = 0,8 meter<br>l = 0,28 meter |
| A (y) = 8 | θ = 30°<br>k = 3 | |
| C(θ) = 4.8 | θ = 30°<br>k = 3 | |
| $\overline{O_hA_1}$ | = 8.64 meters. | |

The particular appropriate form of the incident beam and the angle which it should make with entry face of the first electromagnet, are obtained by means of a "magnetic triplet" comprising three quadripolar lenses arranged in a known fashion in relation to one another.

Self-evidently, it is possible to obtain triple focusing on the target C by using an incident beam which is convergent not in the horizontal plane as shown in the present example, but in the vertical plane, and with a beam which is parallel in the horizontal plane.

This kind of device can be employed in a medical irradiation unit utilising an iron cyclotron accelerator, this accelerator in particular producing deutous having energies in excess of 20 Mev which, after impact upon a target, produce a neutron beam. The focal spot obtained with this ion beam impacting upon the target, can have excellent quality if the emittance value of the incident beam has been properly chosen.

What we claim is:

1. A magnetic deflecting and focusing device for a beam of accelerated charged particles having an incident mean path $T_o$, comprising, in combination, magnetic means for translating said beam in a direction perpendicular to said incident mean path $T_o$ to obtain a translated beam parallel to said incident mean path $T_o$, the particle paths of said translated beam being dependent upon the momentum of said particles, and magnetic means for deflecting and focusing said translated beam upon a target having a predetermined position, said magnetic means for translating and said magnetic means for deflecting and focusing said beam being positioned and configured so as to achieve convergence of said particle beam on said target in two mutually perpendicular planes whose intersection is coincidental with the mean path of said beam emerging from said device, the positioning and configuration of said magnetic means further being such that momentum convergence of said particle beam is simultaneously achieved on said target substantially located on the axis corresponding to the mean path $T_o$ of the incident beam; said magnetic means for translating said beam comprising a first and a second electromagnet having respectively an entry face and an exit face parallel to one another; the entry face $A_1$ of said first electromagnet being perpendicular to said incident mean path $T_o$ and the exit face $B_2$ of said second electromagnet being perpendicular to said particle beam emerging from said second electromagnet; the entry face $A_2$ of said second electromagnet being parallel to the exit face $B_1$ of said first electromagnet and said faces $A_2$ and $B_1$ being spaced of an interval of:

$$d = 2r/tg\theta$$

the normal to said beam at the exit face $B_1$ and at the entry face $A_2$ being respectively at an angle θ with said entry face $A_1$ and said exit face $B_2$ and $r$ being the radius of curvature of said particle beam within said first and second electromagnet.

2. A device as claimed in claim 1, wherein said means for deflecting and focusing said particle beam comprise a third electromagnet having an entry face $A_3$ arranged at a distance L from the exit face $B_2$ of said second electromagnet, said entry face $A_3$ being at an angle α with the normal to the mean path of said beam entering said third electromagnet, the entry face $A_3$ and exit face $B_3$ of said third electromagnet being so arranged in relation to one another that said beam is deflected through an angle β in said third electromagnet.

3. A device as claimed in claim 2, wherein said parameters, θ, α, β, L, r and R which is the radius of curvature of the mean path of the beam is said third electromagnet $E_3$, are associated with one another by the relationships:

$$tg\,\alpha = 1/y + \beta \qquad (1)$$

where:

$$y = 1/R$$

1 being the distance between said target and said exit face of said third electromagnet, $$\frac{1 - y\,(y + \beta)}{y + \beta} \approx 0 \qquad (2)$$

$$\frac{1 - y\,(y + \beta)}{y + \beta} \cdot 2r \cdot (\frac{2}{\cos\theta} - 1) - R\,(1 + y) = 0 \qquad (3)$$

and:

$$\frac{a\,p_o + b\,(L)}{c\,p_o + g\,(L)} = 0 \qquad (4)$$

where:

$$a = -\,tg\,\alpha - \frac{1}{R} = -\,(tg\,\alpha + y) \qquad (5)$$

-continued $$b(L) = \left(-\,tg\,\alpha - \frac{1}{R}\right)\left[2r\,tg\,\theta\left(1 + \frac{1}{\sin^2\theta}\right) + L\right] + R \tag{6}$$

$$c = -\frac{1}{R} \tag{7}$$

$$g(L) = -\frac{1}{R}\left[2r\,tg\,\theta\left(1 + \frac{1}{\sin^2\theta}\right) + L\right] \tag{8}$$

to achieve the convergence of said particle beam upon said target, into said two perpendicular planes, $p_o$ being the distance separating the entry face $A_1$ of said first electromagnet from the point of convergence of said incident beam.

4. A device as claimed in claim 3, wherein correcting means are located up stream from said first electromagnet, said correcting means make it possible to obtain a parallel particle beam with $p_o = \infty$, $a/c = 0$, before entering said first electromagnet.

5. A device as claimed in claim 3, wherein correcting means are located up stream from said first electromagnet, said correcting means make it possible to obtain a convergent incident beam at least in one of said mutually perpendicular planes before entering said first electromagnet, the point of convergence of said incident beam being conjugate with the point of convergence of said beam upon said target, this corresponding to $p_o = -b(L)/a$.

* * * * *